US005495338A

United States Patent [19]

Gouriou et al.

[11] Patent Number: 5,495,338

[45] Date of Patent: Feb. 27, 1996

[54] PROCESS FOR MAKING UP THE FACE, PARTICULARLY THE EYES, AND DEVICE FOR CARRYING IT OUT

[75] Inventors: Eliane Gouriou, Issy-les-Moulineaux; Annie Raynal; Régine Baudet, both of Orleans; Jean-Pierre Hulaud, La Forest Landerneau; Alain Denis, Fay-aux-Loges, all of France

[73] Assignee: Parfums Christian Dior, Paris, France

[21] Appl. No.: 94,690

[22] Filed: Jul. 22, 1993

[51] Int. Cl.[6] ..... G01J 3/50

[52] U.S. Cl. ..... 356/402; 354/62; 434/100

[58] Field of Search ..... 356/402; 434/99, 434/100; 354/62

[56] References Cited

U.S. PATENT DOCUMENTS

| | | | |
|---|---|---|---|
| 4,561,850 | 12/1985 | Fabbri et al. | 434/98 |
| 4,921,344 | 5/1990 | Duplantis | 354/62 |
| 5,313,267 | 5/1994 | MacFarlane et al. | 356/405 |

FOREIGN PATENT DOCUMENTS

| | | |
|---|---|---|
| WO-A-8605018 | 8/1986 | European Pat. Off. . |
| EP-A-0226959 | 7/1987 | European Pat. Off. . |
| 2194335 | 2/1974 | France . |
| 3419568 | 11/1985 | Germany . |

OTHER PUBLICATIONS

European Search Report (with Annex) dated Aug. 2, 1993.

*Primary Examiner*—Vincent P. McGraw
*Attorney, Agent, or Firm*—Bryan Cave

[57] ABSTRACT

A process for making up the face, in particular the eyes, and a device for carrying it out, is disclosed comprising determining the different individual colors of the iris of the eyes comprising the iris contour color and the iris sparkle color(s) and using these iris determined colors for selecting make-up products to effect personalized make ups of the face, and of the eyes.

31 Claims, 5 Drawing Sheets

PROCESS FOR MAKING UP THE FACE, PARTICULARLY THE EYES, AND DEVICE FOR CARRYING IT OUT

The present invention essentially relates to a process for making up the face, in particular the eyes, and to a device for carrying it out. More particularly, the invention concerns a process for the personalized making up of the eyes (upper and lower lids, inner edge of these lids, lashes and eyebrows), as well as a device for assisting in the choice of shades of make-up products.

Up to the present time, the making up of the face, particularly the making up of the eyes, was effected by rule-of-thumb and little personalized manner. When it was desired to harmonize the shades of the make-up with the color of the eyes, one was generally limited to the use of a relatively limited number of make-up shades adapted solely to the colors of the main classes of eyes (black, brown, blue and green). In fact, no one had envisaged, in order to render the make-up more personal, reproducing therein, in very precisely adjusted manner, the different individual colors characteristic of the iris of the eye of each individual. Thus, many of these precise shades did not exist, particularly in the form of pencils or eye shadows, and those which did exist were for the most part dispersed between different sales points, which, geographically, were very far from one another. It was therefore virtually impossible, with the make-up products on the market, to make up the face and in particular the eyes in a particularly personalized way taking into account the various colored shades characteristic of each iris.

The present invention therefore has for its object to solve the new technical problem consisting in providing a solution allowing personalized make-up of the face, in particular the eyes, and facilitating the choice of the shades of products for effecting such make-up.

The invention also proposes to provide a simple solution to this problem which may be used by a person without particular training.

The present invention is based on the discovery of the fact that it was possible to obtain a personalized make-up of high aesthetic value by analysis of the different colored zones of the iris and that the richness of the characteristic colors of the irises made it possible to create new, more varied shades and to enrich the existing shades of the make-up products.

In fact, it has been observed that, although in relatively limited number, these different individual colors generate, by reason of their localization and their extent in the iris, an infinity of combinations, each combination being in practice characteristic of an individual.

Thus, according to a first aspect, the present invention provides a process for making up the face, in particular the eyes, characterized in that, in a first stage, the different individual colors of the iris of the eye of the face to be made up are determined by appropriate color determining means and, in a second stage, there are applied on the zones of the face to be made up one or more make up products whose shade corresponds to one of the above-mentioned individual colors of the iris in order to effect a personalized make-up of the face, in particular of the eyes.

It will be specified that, in the present description, the term "correspondence" between the shade of a make-up product and an individual color of the iris is understood to mean the fact that this shade is substantially identical to said individual color or that it was previously chosen by an expert in the make-up field as being able to match said individual color from an aesthetic point of view.

It will also be specified that, within the meaning of the present invention, the expression "personalized make-up" means that the different individual colors of the iris are taken into account with a very high precision, either these different colors are reproduced in very precise manner or make-up products are used whose shade has been matched to one of these very precise colors.

According to a second aspect, the present invention also provides a process for assisting in the choice of shades of make-up products of the face, in particular make-up of the eyes, characterized in that one or more individual colors of the iris of the eye of the face to be made up are determined by appropriate color determining means, and at least one of these colors is used as reference shade in the choice of make-up products, with a view to effecting a personalized make-up of the face, in particular of the eyes.

According to a particular variant embodiment of either one of the above-mentioned processes of the invention, the color of the contour of the iris is determined.

According to another particular variant embodiment, the impression color of the iris is determined.

According to yet another particular variant embodiment, the sparkle color or colors of the iris is/are determined.

The term "contour color" of the iris is understood to mean the color of the iris localized on its periphery.

The term "impression color" of the iris is understood to mean the dominant color of the iris. In practice, this impression color may be a color resulting from the average or the integration of all the colors within the iris, included between the contour color of the iris and the pupil.

The term "sparkle color" of the iris is understood to mean the color of the different dots or marks of small dimensions, distributed over the surface of the iris between the pupil and the contour. Each iris generally comprises from 1 to 5 sparkle colors. The sparkle colors generally give the look the essential of one's personality.

According to a particular embodiment of the processes of the invention mentioned above, the iris is illuminated with a determined light, for example daylight or the light of a lamp of defined characteristic(s), and a colored image of the iris is taken with a color image-taking device, such as a photographic apparatus preferably comprising a function of digitalization of the image, or a color video camera preferably having very good chromatic performances.

According to a particular variant embodiment, the localization and surface of the areas of each of the colors which characterize the iris are determined and the results are used to determine the contour color, the sparkle color(s) and the impression color.

According to a particular embodiment of the invention, pencils such as kohl pencils or eye-liner pencils, mascaras, eye shadows, in particular in the form of compressed powders, cheek blushes or lipsticks, are chosen or used as make-up products.

Advantageously, the pencils preferably correspond to the contour and impression colors, the mascaras preferably correspond to the contour color, and the eye shadows, as well as the blushes and lipsticks, preferably correspond to the sparkle colors.

According to another particular embodiment of the above-mentioned processes of the invention, one or more lists of make-up products are made to correspond, in a preliminary step, to different particular combinations of individual colors of iris, in particular contour, impression and sparkle colors, and for each of these combinations, each list making it possible to effect a particular type of make-up of which the shade or shades correspond to one or several colors of said combination, and then, after having determined the individual colors of the iris of the face to be made up, the comparison is made between the combination of colors of this iris on the one hand and the different particular combinations mentioned above on the other hand, so as to determine from the latter which is the one closest to the iris in question, or as the case may be, which are the closest ones, thus making it possible to obtain one or more lists of make-up products so as to effect a personalized make-up of the face, in particular of the eyes.

The above-mentioned particular combinations of individual colors of iris are preferably chosen so that they constitute together a sample representative of a population of individuals concerned. Several variant combinations of colors are advantageously chosen in each class of the classification of eye colors described hereinafter. The number of these particular combinations used for carrying out the particular embodiment mentioned above is generally between 50 and 150, preferably included between 80 and 110.

According to a particularly advantageous embodiment of the process of the invention, the eye is illuminated by centering the illumination on the pupil, which may easily be effected for example with the aid of optical fiber(s). Once centering on the pupil is effected, —a color image of the iris is taken with a color image-taking device such as a photographic apparatus or a color video camera mentioned above, —with the aid of an image analysis device particularly employed with the use of a computer such as a microcomputer, registration of the pupil and withdrawal thereof from the image is effected, —then the contour of the eye is registered by difference between the white of the eye and the color of the eye, which then makes it possible to determine the contour color of the iris at the limit of the white of the eye.

—the contour color is then withdrawn and an average or an integration is made of all the colors within the iris located between the contour color and the pupil, resulting in the impression color.

In the case of a color image-taking with a color video camera, the sparkle color(s) of the iris are sought with the aid of the pixels automatically processed by the computer in order to give a purified iris. On the purified iris, a matrix is defined and by contrast the sparkle colors are determined.

In the particular case of a color photo, this photo may be filmed with a color video camera to proceed with the definitions of the contour, impression and sparkle colors as described previously, but, in order to obtain a better quality of the result, a photo apparatus is preferably used which comprises a function of digitalization of the image.

Furthermore, studies conducted by Applicants on a large number of irises have shown that the different individual colors existing might be applied to a palette of colors in limited number, ranging from very dark brown to black, passing through different lighter shades such as medium brown, light brown, ochre, mastic, pale yellow, grey, turquoise, lavender, grey-blue, verdigris, khaki, pine green, blue with violet glints, navy blue and dark blue.

Thus, according to a third aspect, the present invention concerns a range of products for making up the face, particularly the eyes, comprising in particular eye shadows, mascaras, pencils such as khol pencils or eye-liner pencils, blushes and lipsticks, characterized in that the shades of said range are chosen with respect to a palette of colors in limited number, said colors corresponding to the individual colors existing in the irises of the eye, said range making possible in particular the personalized making-up of the face, in particular the eyes, as defined previously.

Preparation of said make-up products may be effected in accordance with techniques well known to the man skilled in the art, using the appropriate pigments available on the market.

According to a particular embodiment of the invention, the palette of colors mentioned above comprises about 40 colors, ranging from very dark brown to black, passing through different lighter shades, such as medium brown, light brown, ochre, mastic, pale yellow, grey, turquoise, lavender, grey-blue, verdigris, khaki, pine green, blue with violet glints, navy blue and dark blue.

The range of make-up products according to the invention advantageously comprises at least fifteen different shades chosen from said palette of colors.

According to another variant, the said range comprises at least fifteen shades of pencils, and/or at least five shades of eye shadows, and/or at least four shades of mascaras, said shades being chosen from said palette of colors.

According to a fourth aspect, the present invention also provides a device for assisting in the choice of shades of make-up products, characterized in that it comprises means for illuminating the iris under determined conditions of illumination, and means for taking a color image of the iris, as well, preferably, as computer means capable of determining in particular the localization and the surface of the areas of individual colors which characterize the iris.

According to a particular embodiment, illumination means on the market are used, preferably of the annular illumination type for stereoscopic microscopy, particularly in the form of a toric neon tube, or preferably of the optical fiber illumination type, such as the "Fiber optic L 151" model by the firm HEIM A. G. (Switzerland). The illumination means advantageously produce so-called "daylight" or "northern light".

According to another particular variant embodiment, the means for taking a color image of the iris comprise a color video camera, preferably having very good chromatic performances, transmitting luminous information to computer means, for example a micro-computer or computer, equipped with a video card, and advantageously with display means such as a screen and/or a printer. The computer means advantageously make it possible to assess the characteristics of luminosity and the chromatic characteristics, for example in RVB coordinates, and to quantify the luminous information received in the form of signals transmitted by the video camera via said video card. They also comprise in memory different particular combinations of individual colors of irises, as well as, associated with each of these latter, one or more lists of make-up products for example in the form of commercial references, and may display on the display means, on the one hand the different individual colors of the iris analyzed and, on the other hand, the list or different lists of make-up products corresponding to the different individual colors of this iris, taken separately or in combination.

These different individual colors of the iris analyzed are advantageously classified as sparkle, contour and impression colors.

According to another particular embodiment, the above-mentioned image-taking means comprise a photographic apparatus and a color film as well as means for developing into photographic images, and preferably a device comprising a function of digitalization of the image in order to make it possible to determine the individual colors as a function of their localization in the iris.

Thus, thanks to the invention, it is possible to determine in simple, reliable, substantially inexpensive manner, without particular training, the individual colors of the iris which may be used as basic shades in the choice of make-up products to effect a personalized make-up of the face, in particular of the eyes.

It may thus be provided that the computer means are capable of determining a list of recommended products, possibly with a plurality of variants in each range of make-up products available on the market, or preferably in a range of make-up products according to the present invention, and of printing with the aid of a printer this list which is presented to the person whose iris has thus been analyzed.

Other objects, characteristics and advantages of the invention will appear in the light of the explanatory description which follows, with reference to the accompanying schematic drawings given solely by way of non-limiting examples illustrating a presently preferred embodiment of the invention, and in which.

Figure 3:
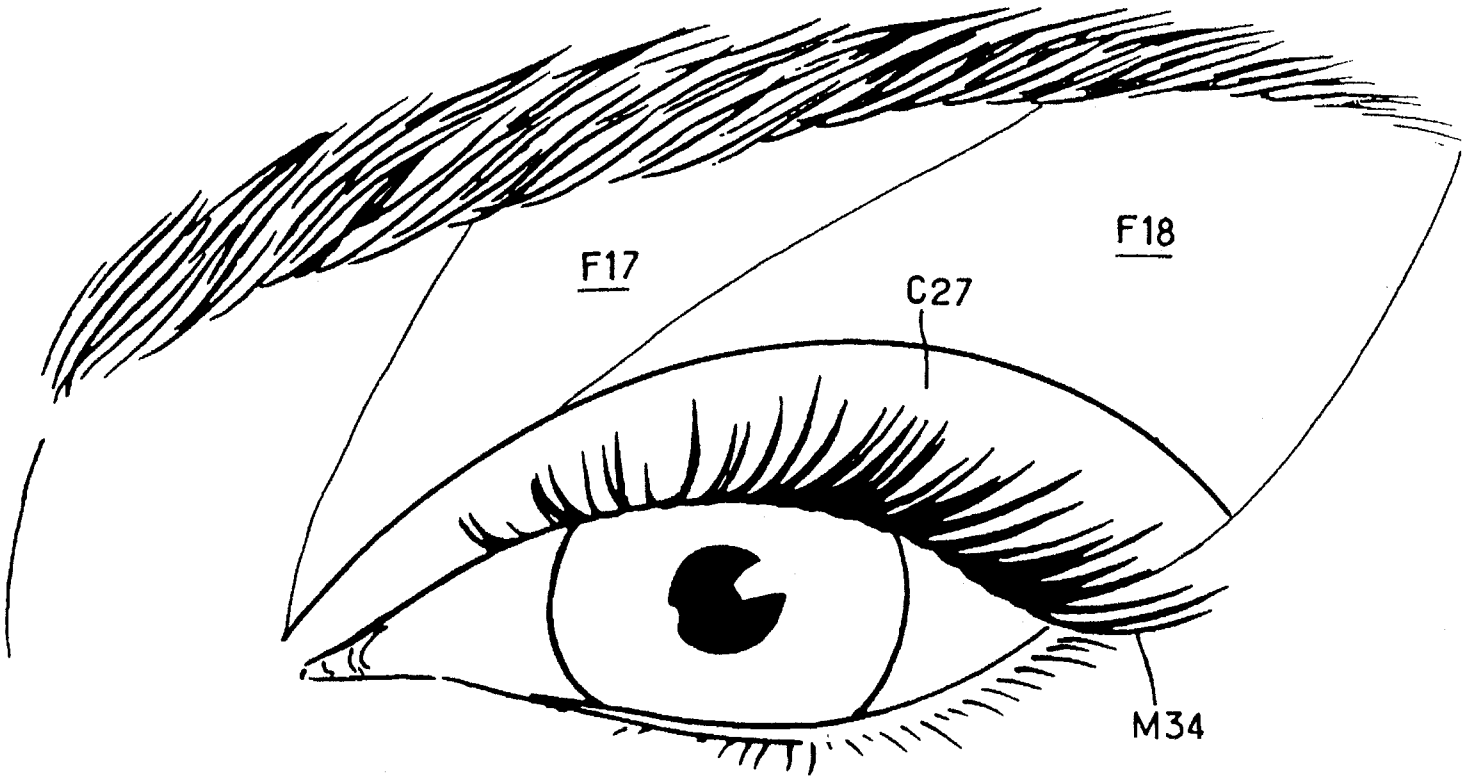
Figure 4:
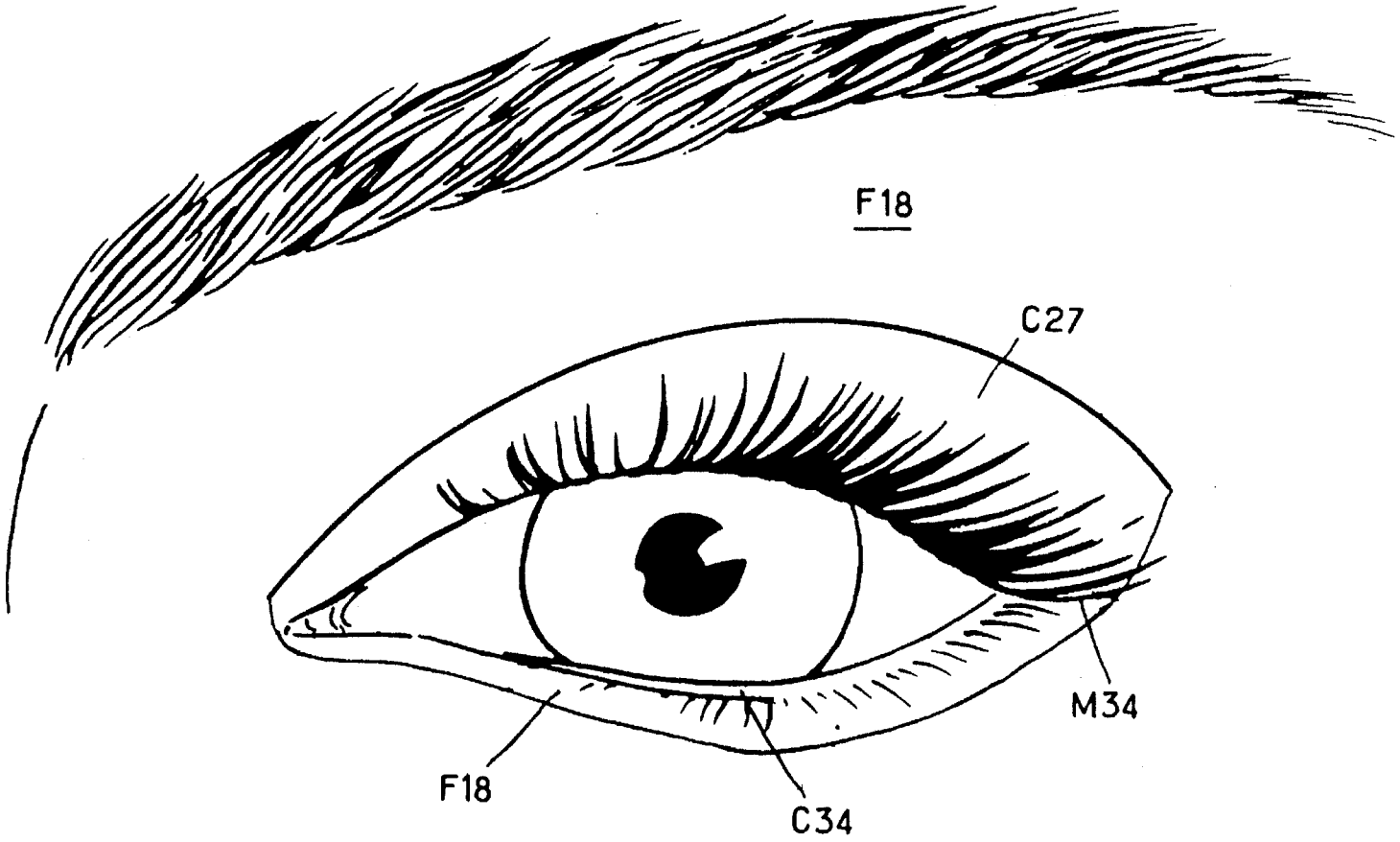
Figure 5:
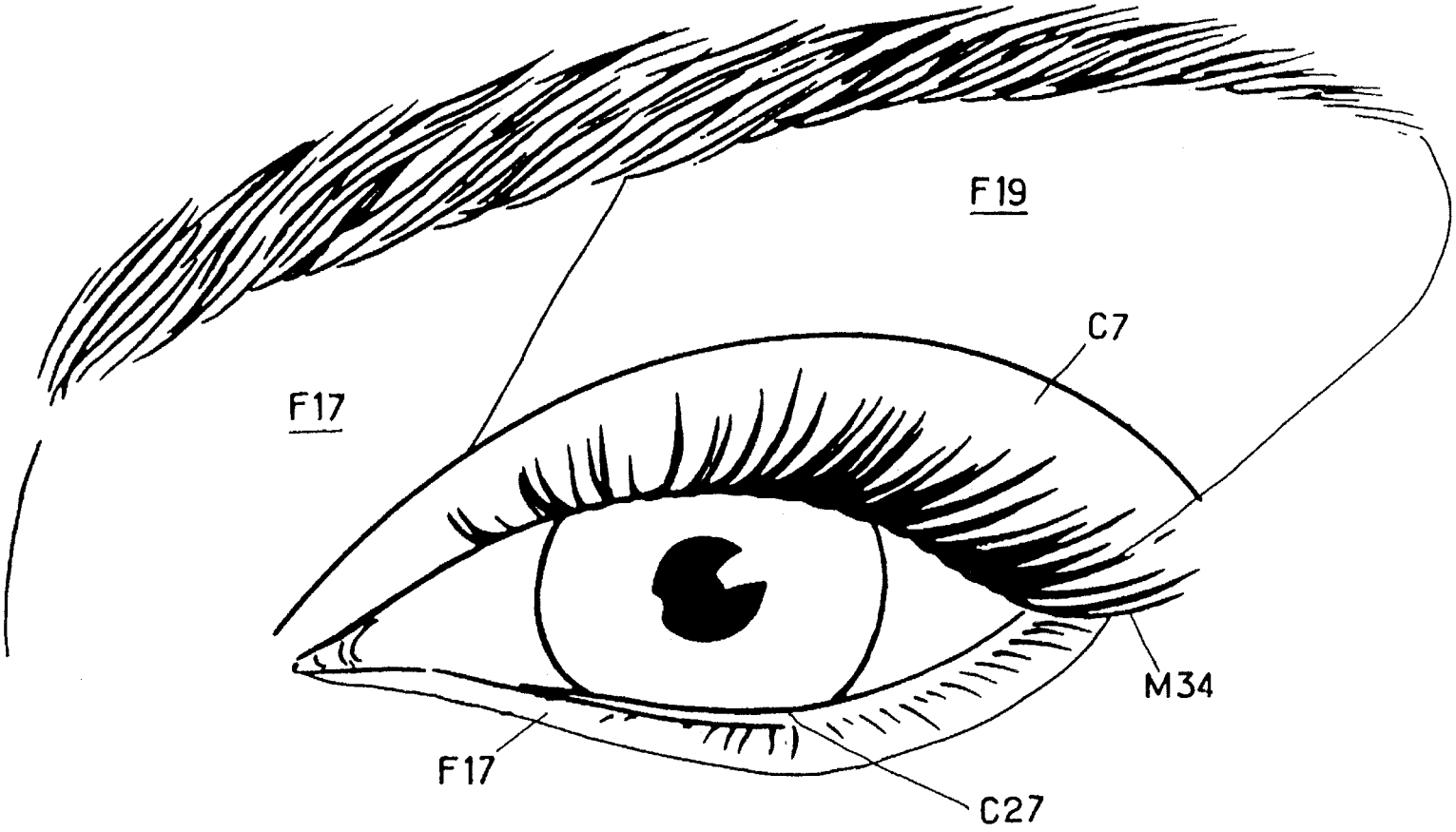

FIGS. 3 to 5 schematically show three different personalized make-ups of the same eye, employing the process of the invention by means of make-up products chosen from the range of the invention.

Figure 1:
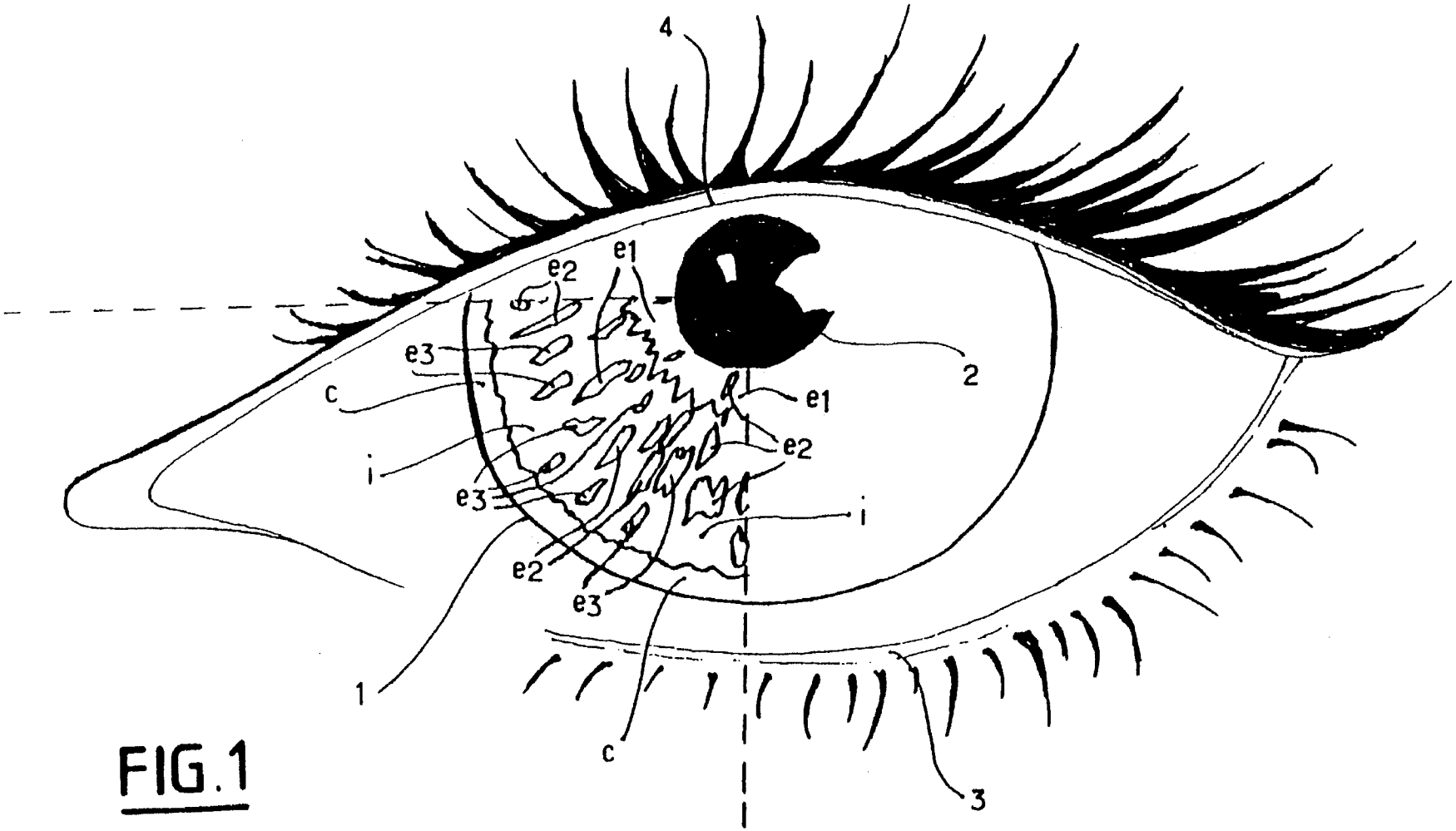
FIG. 1 is a schematic front view of an eye showing the different characteristic zones of the iris.

FIG. 1 therefore schematically shows a front view representing an eye.

For reasons of clarity of the Figure, the colored zones have been represented only over a sector of the iris, but these zones are, of course, distributed over the whole of the iris.

Figure 2:
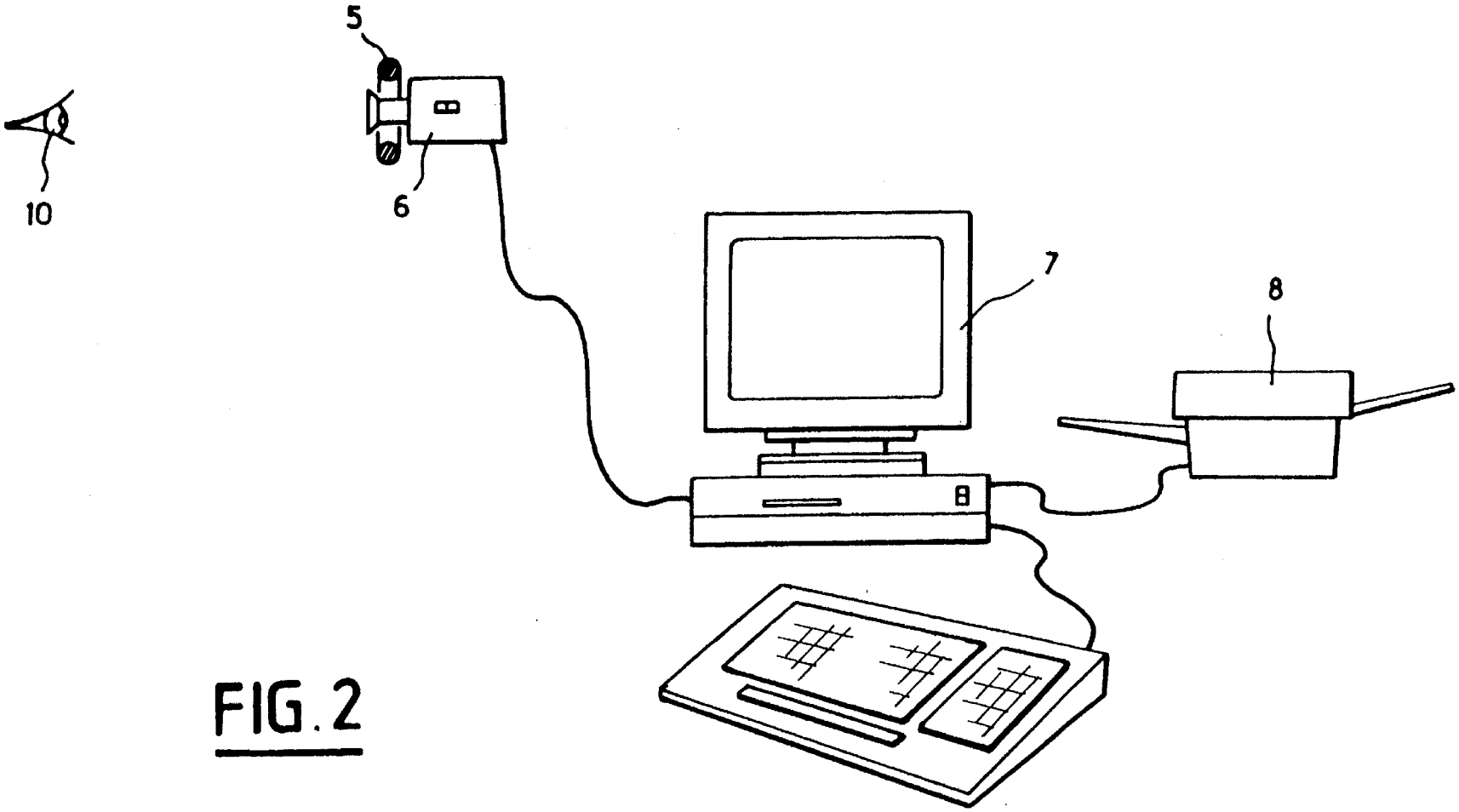
FIG. 2 is a schematic view illustrating a device for assisting in the choice of shade of make-up products according to the invention.

Reference FIG. 1 generally designates the iris, FIG. 2 the pupil, FIG. 3 the lower edge of the upper lid and FIG. 4 the upper edge of the lower lid.

The colored zones characteristic of the iris have generally been designated by the letters c for the zone corresponding to the contour color, i for the zone corresponding to the impression color and $e_1$, $e_2$, $e_3$ for the zones corresponding to the different sparkle colors (three different colors in the example shown).

By way of purely illustrative example, an eye of dark hazel color may have the following colored zones:

c: very dark brown i: dark brown $e_1$: yellow ochre $e_2$: dark green $e_3$: light brown The observation of the characteristic colors of the eyes of about a hundred persons made it possible to establish a classification of the colors of eyes given in Table I, the definitions making it possible to establish this classification being, in addition, given in Table II.

In Table II, the mentions "c", "i" and "e" indicate that the colors cited are generally, and respectively, contour, impression and sparkle colors.

TABLE I

| CLASSIFICATION OF EYE COLOURS |
|---|
| BROWN EYES |
| DARK BROWN |
| DARK HAZEL |
| LIGHT HAZEL |

TABLE I-continued

| CLASSIFICATION OF EYE COLOURS |
|---|
| OCHRE |
| GREEN EYES |
| KHAKI |
| GOLDEN GREEN |
| VERDIGRIS |
| BLUE EYES |
| VERY LIGHT BLUE |
| BLUE-GREY |
| BLUE |

TABLE II

| DEFINITIONS OF EYE COLOURS |
|---|
| DARK BROWN M1<br>Different browns (i) associated, or not, with black (c). |
| DARK HAZEL M2<br>Mixture of browns (i and e) and dark greens (c). |
| LIGHT HAZEL M3<br>Mixture of browns and greens (c and i) with ochre (e) and yellow ochre (e) spots. |
| OCHRE M4<br>Same mixture with the ochres (i) in larger quantity than the greens (e and c) and the browns (e and c). |
| KHAKI VI<br>Much green (c and i), a little pale yellow (e) and some ochre spots (e). |
| GOLDEN GREEN V2<br>Mixture in approximately equal quantities of green (c), green-yellow (i) and different ochres (e) associated with pale yellows (e). |
| VERDIGRIS V3<br>Mixture of green-yellow (c and i) and of green-blue (c and i) in large quantities with greys (e) in smaller quantity, which sometimes gives these eyes a blue glint. |
| VERY LIGHT BLUE B1<br>Mixture of different blues (c and i) with violet (e) or turquoise (e) and offwhite (e) glints which renders them very transparent. |
| NAVY BLUE B2<br>Mixture of different fairly strong blues (c and i) sometimes almost black in a large quantity and of offwhite (e), grey (e) or blue (e) in small quantity. |
| GREY-BLUE B3<br>Mixture of grey-blue (c and i) in large quantity with offwhite (e) in smaller quantity, with sometimes a verdigris (e) and spots of ochre (e). These are the most changing eyes. |

FIG. 2 schematically shows a device for assisting in the choice of shade of make-up products according to the present invention.

This device generally comprises means 5 for illuminating the iris under determined conditions of illumination; means 6 for taking a color image of the iris as well as computer means 7 make it possible to determine in particular the localization, the chromatic coordinates, the intensity and the surface of the zones of individual colors which characterize the iris.

This device may comprise in addition a means for holding the head such as for example a head-rest, and possibly a chin-rest, but an articulated arm is preferably used, bearing a camera whose lens is located in an eye-piece. The eyepiece is preferably in the form of a tube whose length makes it possible to obtain a pre-adjustment of focal distance, which may be improved thanks to a means for finely adjusting the focal distance, such as a knurl, as is well known to the man skilled in the art.

Said illumination means 5 generally comprise at least one lamp, for example a toric luminescent neon tube generating a light of daylight or northern light type. This toric tube will for example have an outer diameter of 7 cm and an inner diameter of 5 cm. In place of the luminescent tube as illumination means, illumination employing optical fibers will preferably be used, having for example an outlet section of about 5 mm diameter. Two optical fibers may be used, disposed on either side of the shot-taking lens, of which the illumination light is centered on the pupil, which in certain cases, when withdrawing the pupil from the image, may make it possible also to withdraw the image of the illumination beam which usually constitutes a slight disturbance in the determination of the colors.

The means 6 for taking a color image of the iris generally comprise a color video camera having good chromatic performances such as for example a CCD type camera.

The lens of the video camera is preferably placed at the center of the toric tube, as shown in FIG. 2. When an optical fiber type illumination is used, it is placed near the lens of the camera and directed towards the eye to be analyzed, centering the light on the pupil.

This video camera is connected to computer means 7 comprising for example a micro-computer advantageously equipped with display means such as a screen and a printer.

The image obtained by means of the video camera is stored via the video card, then processed by the microcomputer. The latter may advantageously be equipped with a micro-processor of the 80/386, or preferably 80/486, type, with a hard disc of 40 mega-octets. The screen will advantageously be a color screen of V.G.A. type.

The computer means 7 make it possible to determine the characteristics of luminosity and the chromatic characteristics, for example in RVB coordinates of each individual color of the iris, i.e. the different contour, impression and sparkle colors defined hereinbefore.

To that end, and in accordance with the process described hereinabove in the preamble of the present specification, after having registered the pupil and withdrawn it from the image, the image analysis means seek the contour color by difference between the white of the eye and the iris, at the limit of the iris to define a contour color of the iris.

The image analysis means then withdraw the contour color and effect an average or integration of all the colors within the iris defined between the contour of the iris and the pupil to determine an impression color.

Finally, the sparkle color(s) are sought from the pixels of the image, which gives a purified iris. From the purified iris, the image analysis means form a matrix which, by contrast, determines the sparkle colors.

The data thus obtained are compared with a data base grouping different particular combinations of iris colors, generally corresponding to a certain number of characteristic eyes, with which one or more lists of make-up products are associated.

Thus, after comparison with this data base, said computer means makes it possible to determine a list of recommended products, possibly with several variants in each range of make-up products available on the market such as eye shadows, mascaras or pencils, or preferably in a range of make-up products according to the invention, and to print this list with the aid of a printer 8, which list is offered to the person whose iris has thus been analyzed.

It should be noted that said data base may be enriched with new combinations of iris colors, particularly on the occasion of analyses such as those mentioned above.

FIGS. 3 to 5 represent, for the same face, three different personalized make-ups, after having carried out the processes of the invention, by means of make-up products chosen from a range of products of the invention.

Analysis of the iris of the eyes of this face gave the following results:

—contour color: dark blue-grey (c)

—impression color: medium grey-blue (i)

—sparkle colors:

—very light turquoise blue ($e_1$)

—golden yellow ochre ($e_2$)

—very light turquoise-grey ($e_3$)

—light lavender ($e_4$)

The make-up products recommended for this face, chosen from the range of products according to the invention, have been gathered together in Table III hereinafter. The shade of each product, figuring in this Table by its commercial reference, is substantially identical to the corresponding individual color of the iris.

In FIGS. 3 to 5, the references indicated are those of the recommended make-up products.

TABLE III

| Individual colours of the iris | Eye shadows | Pencils | Mascaras | Cheek blushes | Lip-sticks |
|---|---|---|---|---|---|
| c | | C34 | M34 | | |
| i | | C27 | | | |
| $e_1$ | F18 | | | | |
| $e_2$ | | C7 | | B7 | R7 |
| $e_3$ | F17 | | | | |
| $e_4$ | F19 | | | | |

It is specified that the blush B7 and the lipstick R7, both of golden yellow ochre, have been recommended only in the case of the make-up of FIG. 4.

Thus, for the make-up of FIG. 3, pencil C27 is applied on the upper lid, shadow F17 above the upper lid towards the inside and shadow F18 towards the outside and, on the lashes, mascara M34.

For the make-up of FIG. 4, there is applied on the upper lid pencil C27, on the inner edge of the lower lid pencil C34, on the lower lid shadow F18, above the upper lid shadow F18, and on the lashes mascara M34.

For the make-up of FIG. 5, there is applied on the upper lid pencil C7, on the inner edge of the lower lid pencil C27, on the lower lid shadow F17, above the upper lid shadow F17 towards the inside and shadow F19 towards the outside, and on lashes, mascara M34.

Thus, for the iris of the present example, constituting a certain particular combination of contour, impression and sparkle colors, it is possible to propose three lists of make-up products presented in Table IV hereinbelow. In addition, the zones recommended for application thereof are indicated.

TABLE IV

| | 1st list make-up FIG. 3 | 2nd list make-up FIG. 4 | 3rd list make-up FIG. 5 |
|---|---|---|---|
| Upper lid | pencil C37 | pencil C27 | pencil C7 |
| Top of upper lid inner part | shadow F17 | shadow F18 | shadow F17 |
| Top of upper lid outer part | shadow F18 | shadow F18 | shadow F19 |
| Lower lid | — | shadow F18 | shadow F17 |
| Inner edge lower lid | — | pencil C34 | pencil C27 |
| Lashes | Mascara M34 | mascara M34 | mascara M34 |
| Cheeks | — | blush B7 | — |
| lips | — | lipstick | — |

TABLE IV-continued

| | 1st list make-up FIG. 3 | 2nd list make-up FIG. 4 | 3rd list make-up FIG. 5 |
|---|---|---|---|
| | | R7 | |

In the present specification and claims, the expression "RVB coordinates" signifies the chromatic coordinates for defining a color with respect to three directions of section corresponding to the basic colors Red, Green and Blue, which coordinates are well known to the man skilled in the art.

What is claimed is:

1. A process for making up the face comprising determining, in a first stage, the different individual colors of the iris of the eyes of the face to be made up, comprising at least one iris color selected from the group consisting of the iris contour color and an iris sparkle color, by appropriate color determining means and, in a second stage, applying on the zones of the face to be made up one or more make-up products whose shade corresponds to one of said individual colors of the iris, in order to effect a personalized make-up of the face.

2. The process of claim 1, wherein the impression color of the iris is further determined.

3. A process according to claim 1, wherein said process for making-up the face comprises a process for making up the eyes in order to effect a personalized make-up of the eyes.

4. A process for assisting in the choice of shades of make-up products for the face comprising determining one or more individual colors of the iris of the eyes of the face to be made up, comprising at least one iris color selected from the group consisting of the iris contour color and an iris sparkle color, by appropriate color determining means, and using at least one of these colors as reference shade in the choice of make-up products, to effect a personalized make-up of the face.

5. The process of claim 4, wherein the impression color of the iris is further determined.

6. The process of claim 4, wherein the iris is illuminated with a determined light and a color image of the iris is taken with a color image-taking device.

7. The process of claim 4, wherein the localization and the surface of the ranges of each of the colors which characterize the iris are determined and the results are used for determining the contour color, the sparkle contour(s) and the impression color.

8. The process of claim 5, comprising choosing pencils selected_from khol pencils or eye-liner pencils; mascaras; eye shadows; blushes; or lipsticks as the make-up product, wherein the pencils correspond to the contour and impression colors, the mascaras correspond to the contour color, and the eye shadows, blushes, and lipsticks correspond to a sparkle color.

9. The process of claim 4, wherein, in a first step, one or more lists of make-up products are made to correspond to different particular combinations of individual iris colors and for each of these particular type of make-up products whose shade or shades correspond to one or more colors of said combination and then, after having determined the individual colors of the iris of the face to be made up, a comparison is made between the combination of colors of this iris on the one hand, and the different particular combinations mentioned above on the other hand, to determine among said different particular combinations, which one is the closest to the iris concerned thus making it possible to obtain one or more lists of make-up products so as to effect a personalized make-up of the face.

10. The process of claim 9, comprising choosing said particular combinations of individual iris colors so that they constitute together a sample representative of a population of individuals concerned.

11. The process of claim 9, comprising choosing between 50 and 150 particular combinations.

12. A range of make-up products for the face comprising eye shadows, mascaras, pencils, blushes and lipsticks, wherein the shades of said range are obtained by choosing said make-up products in a palette of colors in limited number, said palette of colors corresponding to the individual colors existing in the iris of the eye as determined by the process of claim 2, said palette of colors comprising at least a color selected from the group consisting of a contour color of the iris and a sparkle color of the iris.

13. The range of make-up products of claim 12, wherein the palette of colors mentioned above comprises about 40 colors, ranging from very dark brown to black, passing through different lighter shades, such as medium brown, light brown, ocher, mastic, pale yellow, grey, turquoise, lavender, grey-blue, verdigris, khaki, pine green, blue with violet glints, navy blue and dark blue.

14. The range of make-up products of claim 12, comprising at least fifteen different shades chosen from said palette of colors.

15. The range of make-up products according to claim 12, comprising at least fifteen shades of pencils, and/or at least five shades of eye shadows, and/or at least four shades of mascaras, the said shades being chosen from said palette of colors.

16. A process according to claim 4, wherein said process for assisting in the choice of shades of make-up products for the face comprises a process for assisting in the choice of shades of make-up products for the eyes in order to effect a personalized make-up of the eyes.

17. A process according to claim 9, wherein said list of make-up products is made to comprise make-up products for the eyes in order to effect a personalized make-up of the eyes.

18. The process of claim 9, comprising choosing between 80 and 110 particular combinations.

19. The range of make-up products according to claim 12, wherein said range of make-up products comprise make-up products for the eyes.

20. A device for assisting the choice of shades of make-up products, comprising means for illuminating the iris under determined conditions of illumination, means for taking a color image of the iris, as well as computer means for determining at least one iris color selected from the group consisting of the iris contour color and an iris sparkle color from the color image provided by said image color taking means.

21. The device of claim 20, wherein the illumination means are of annular illumination type for stereoscopic microscopy.

22. The device of claim 20, wherein the means for taking a color image of the iris comprise a color video camera having a very good chromatic performances, which video camera comprises a means for transmitting luminous information to a computer means equipped with a video card.

23. The device of claim 22, wherein the computer means assess the characteristics, for example in the form of RVB coordinates, and quantify the luminous information received in the form of signals transmitted by the video camera via said video card, for example in RVB coordinates, and also comprising in memory different particular combinations of individuals iris colors, as well as, associated with each of these latter, one or more lists of make-up products, for example in the form of commercial references, and may display on a display means, on the one hand, the different individual colors of the iris analyzed, and, on the other hand, the or each different lists of make-up products corresponding to the different individual colors of this iris, taken separately or in combination.

24. The device of claim 23, wherein the different individual colors of the iris analyzed are classified as sparkle, contour and impression colors.

25. A device for assisting the choice of shades of make-up products. comprising means for illuminating the iris under determined conditions of illumination means for taking a color image of the iris, as well as computer means for determining at least one iris color selected from the around consisting of the iris contour color and an iris sparkle color from the color image provided by said image color taking means: said computer means further comprising a means for determining a list of recommended products, with a plurality of variants in each range of make-up products available on the market, on in the range according to claim 12, and further comprising a means for list may be offered to a person whose iris has been analyzed by said devices.

26. The device of claim 20, wherein said image-taking means comprise a photographic apparatus comprising a function of digitalization of the image.

27. The device of claim 20, wherein said computer means determine the localization and the surface of the areas of individual colors which characterize the iris.

28. The device of claim 20, wherein said annular illumination means are selected from the group consisting of a toric neon tube and an optical fiber.

29. The device of claim 20, wherein said illumination means produce a so-called "daylight".

30. The device of claim 20, wherein said illumination means produce a so-called "northern light".

31. The device of claim 22, wherein display means are provided.

* * * * *

UNITED STATES PATENT AND TRADEMARK OFFICE
CERTIFICATE OF CORRECTION

PATENT NO. : 5,495,338

DATED : Feb. 27, 1996

INVENTOR(S): Gouriou et al.

It is certified that error appears in the above-identified patent and that said Letters Patent is hereby corrected as shown below:

Title page, add the following section:
--[30] Foreign Application Priority
May 6, 1992 [FR] .....92.05594

[63] This is a continuation of International Application PCT/FR93/00432, with an international filing date of May 5, 1993, now abandoned.--

Signed and Sealed this

Nineteenth Day of November, 1996

*Attest:*

Bruce Lehman

BRUCE LEHMAN

*Attesting Officer*

*Commissioner of Patents and Trademarks*

UNITED STATES PATENT AND TRADEMARK OFFICE
CERTIFICATE OF CORRECTION

PATENT NO. : 5,495,338

DATED : Feb. 27, 1996

INVENTOR(S): Gouriou et al.

It is certified that error appears in the above-identified patent and that said Letters Patent is hereby corrected as shown below:

Title page, add the following section:
--[30] Foreign Application Priority
May 6, 1992 [FR] .....92.05594

[63] This is a continuation of International Application PCT/FR93/00432, with an international filing date of May 5, 1993, now abandoned.--

Signed and Sealed this

Seventh Day of January, 1997

*Attest:*

Bruce Lehman

BRUCE LEHMAN

*Attesting Officer*

*Commissioner of Patents and Trademarks*